US012449206B2

(12) United States Patent
Bittner et al.

(10) Patent No.: US 12,449,206 B2
(45) Date of Patent: Oct. 21, 2025

(54) HEAT EXCHANGER

(71) Applicant: MAHLE INTERNATIONAL GMBH, Stuttgart (DE)

(72) Inventors: Nikolaj Bittner, Esslingen a.N (DE); Uwe Förster, Erdmannhausen (DE); Martin Sievers, Kernen im Remstal (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 182 days.

(21) Appl. No.: 18/358,227

(22) Filed: Jul. 25, 2023

(65) Prior Publication Data

US 2024/0035751 A1 Feb. 1, 2024

(30) Foreign Application Priority Data

Aug. 1, 2022 (DE) ..... 102022207924.8

(51) Int. Cl.
*F28D 7/16* (2006.01)

(52) U.S. Cl.
CPC ..... *F28D 7/16* (2013.01)

(58) Field of Classification Search
CPC ..... F28D 7/16; F28D 7/1607; F28D 1/05391
See application file for complete search history.

(56) References Cited

U.S. PATENT DOCUMENTS 5,579,835 A * 12/1996 Chiba ..... F28F 9/0207 165/174
8,695,689 B2 * 4/2014 Kohl ..... F28F 9/22 165/174
2003/0041610 A1 * 3/2003 Shirota ..... B60H 1/00792 62/509
2003/0221819 A1 * 12/2003 Jang ..... F28F 9/0214 165/173
2004/0256091 A1 * 12/2004 Higashiyama ..... F28D 1/0333 165/174
2014/0069136 A1 * 3/2014 Lim ..... B60H 1/00778 62/436
2018/0292136 A1 * 10/2018 Baek ..... F28F 9/0207
2023/0332836 A1 * 10/2023 Duerr ..... F28F 9/02
2024/0035751 A1 * 2/2024 Bittner ..... F28D 7/16

FOREIGN PATENT DOCUMENTS

DE 102008055624 6/2009
DE 102010043000 5/2012
DE 102010053300 6/2012

* cited by examiner

*Primary Examiner* — Raheena R Malik
(74) *Attorney, Agent, or Firm* — Barnes & Thornburg LLP

(57) ABSTRACT

A heat exchanger that can be flowed through in the x-direction based on the heat exchanger, having at least one first row and a second row of flat tubes, which can be flowed through by a cooling fluid, having a in the z-direction upper collecting tank, and a lower collecting tank, wherein the flat tubes in each row in the y-direction based on the heat exchanger are divided into at least three flat tube groups wherein all flat tubes of a flat tube group are flowed through in the same direction, wherein a cooling fluid inlet of the heat exchanger is communicatingly connected to a first flat tube group of the first row arranged in the y-direction in a middle region.

Figure 1:
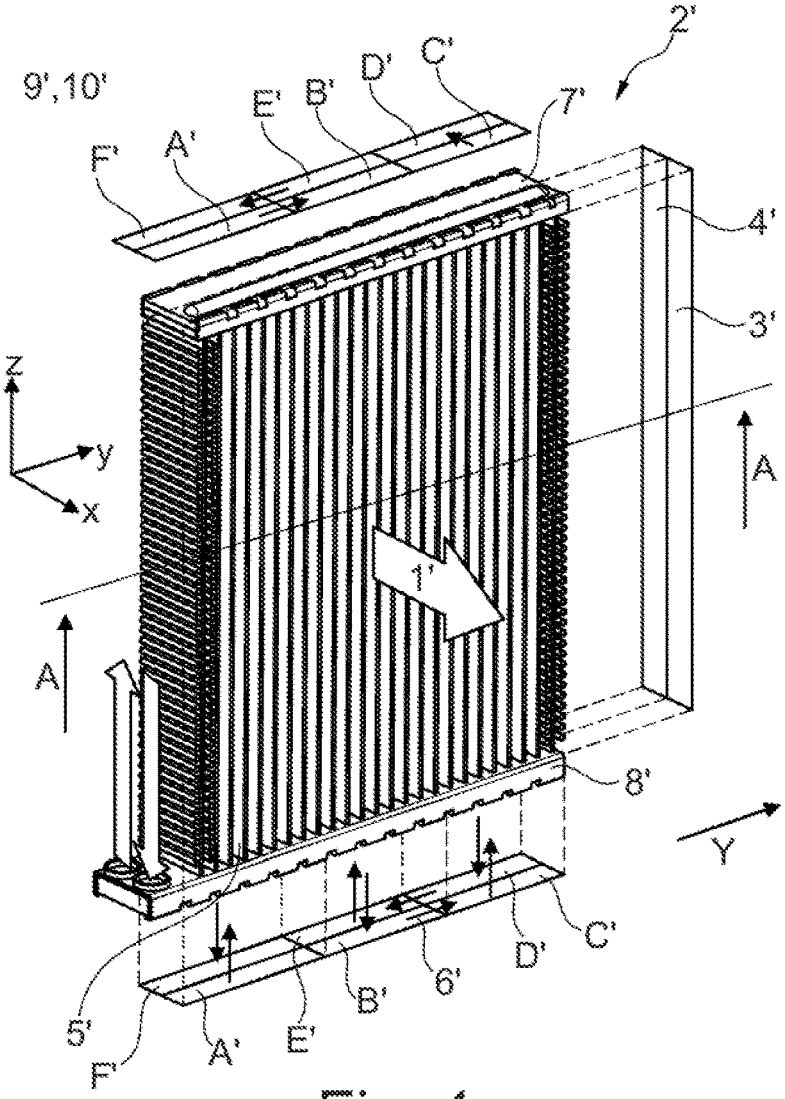

By way of this, a homogenous temperature distribution can be achieved.

11 Claims, 6 Drawing Sheets

HEAT EXCHANGER

This application claims priority from German Patent Application Number DE 10 2022 207 924.8, filed on Aug. 1, 2022, the entirety of which is incorporated by reference herein.

The present invention relates to a heat exchanger.

Besides a PTC heating element, a heat pump can also be employed for air-conditioning, in particular heating electric vehicles. This has the advantage that the range reduction as a consequence of an energy consumption compared with the PTC heating element can be significantly reduced. Alternatively, such a heat pump can also be employed in other vehicles such as diesel, petrol or hybrid vehicles. In the heat pump mode, a heat pump heater is utilised for heating a passenger compartment and is therefore arranged in an air-conditioning system of the vehicle. Because of the little installation space that is available, the heat pump heater has to manage with significantly less installation space.

Known heat pump heaters are of the single-row or two-row type, wherein heat exchangers with high capacity employed for this purpose are generally of the two-row type. Single-row heat exchangers generally have a poorer temperature profile.

Disadvantageous with single-row heat exchangers is that these, because of the design, only have one row of flat tubes as a result of which they have a poorer temperature profile since a region with overheated and undercooled refrigerant is no longer compensated from the air side and is thus becomes directly visible in the air temperature profile. In order to improve the temperature profile here it is known from DE 2010 043 300 A1 to specify a predefined flow path through the individual flat tubes.

Compared with single-row heat exchangers, two-row heat exchangers have a better temperature profile and a higher capacity. Despite this, the capacity level that can be achieved with such two-row heat exchangers is often still unsatisfactory. In order to be able to further increase the capacity, a division into further flow paths is therefore required. This increases the flow rate of the refrigerant on the inside and thus also the heat transfer on the inside. In addition, the temperature profile worsens significantly since the air, dependent on the position, does not pass the same refrigerant-side flow paths and thus not the same refrigerant-side temperature levels.

For the comfort of the occupants it is important that the heat pump heater has as homogenous as possible a temperature profile. The heat pump heaters can be operated with different refrigerants such as for example R1234yf, R134a or R744. To all refrigerants, however in particular with the last mentioned one, a large temperature response and thus a large temperature spread of the refrigerant and thus an unfavourable temperature profile even with multi-row heat exchangers occurs because of the high inlet temperatures of the medium. In particular a large temperature distribution between left and right (y-direction) in the respective heat exchanger renders multi-zone air-conditioning systems difficult, which require as homogenous as possible a temperature distribution between right and left.

The present invention therefore deals with the problem of stating for a heat exchanger an improved or at least an alternative embodiment, which makes possible in particular a significantly improved since more homogenous temperature distribution.

According to the invention, this problem is solved through the subject of the independent claim 1. Advantageous embodiments are subject of the dependent claims.

The present invention is based on the general idea of arranging for the reduction of a temperature differential between right and left side of a heat exchanger (y-direction), an entry of hot cooling fluid or refrigerant into the heat exchanger in a middle region, preferentially in the middle. In a middle region can mean in the y-direction approximately 50% of the transverse extent of the heat exchanger, so that the middle region to a for example 50 cm wide heat exchanger can extend from 12.5 cm to 37.5 cm. A first flat tube group arranged in a middle region can also mean one arranged between two flat tube groups in the y-direction before and after. The heat exchanger according to the invention, which can act as heat pump, can be flowed through by air in the x-direction (usually travelling or longitudinal direction) based on the heat exchanger and has at least one first row of flat tubes and a second row of flat tubes arranged before in the x-direction. The first rows of flat tubes thus lies in the x-direction after the second row of the flat tubes. The flat tubes are oriented in the z-direction (usually height direction) based on the heat exchanger and can be flowed through by a cooling fluid. The heat exchanger comprises an in the z-direction upper collecting tank and a lower collecting tank, wherein the flat tubes in each row are divided in the y-direction based on the heat exchanger into at least three flat tube groups. All flat tubes of a flat tube group are flowed through in the same direction, wherein a cooling fluid inlet of the heat exchanger is communicatingly connected to a first flat tube group of the first row that is arranged in the y-direction in a middle region, i.e. largely in the middle. The cooling fluid inlet can be directly connected to the first flat tube group or indirectly via the lower collecting tank to the first flat tube group. A hot zone, which leads through the first flat tube group, is now located in the middle. Temperature differentials in the flow direction of the air (x-direction) remain unchanged compared with an embodiment according to the prior art. The mean temperature of the left and right half however differs substantially less from one another. In an air-conditioner, comprising in the x-direction two rows of flat tubes, these two rows or zones thus have more uniform temperatures. All in all, a significant improvement of the temperature profile with respect to the temperature differential between left and right half of the heat exchanger with constantly high capacity can thus be achieved with the heat exchanger according to the invention.

In an advantageous further development of the solution according to the invention having six flow paths and two rows of flat tube groups it is provided that the cooling fluid in the first flat tube group arranged in the middle flows in the z-direction, wherein the first flat tube group, via the upper collecting tank, is communicatingly connected to a second flat tube group arranged in the y-direction in the first row next to the first flat tube group, in which the cooling fluid flows counter to the z-direction. The second flat tube group is communicatingly connected via the lower collecting tank to a third flat tube group arranged counter to the x-direction in the second row, in which the cooling fluid flows in the z-direction. The third flat tube group is communicatingly connected via the upper collecting tank to a fourth flat tube group arranged counter to the y-direction and in the x-direction in the first row, in which the cooling fluid flows counter to the z-direction while the first flat tube group is communicatingly connected via the lower collecting tank to a fifth flat tube group arranged counter to the x-direction in the second row, in which the cooling fluid flows in the z-direction. The fifth flat tube group is communicatingly connected via the upper collecting tank to a sixth flat tube group arranged in the y-direction in the second row next to the fifth flat tube group, in which the cooling fluid flows counter to the z-direction, wherein the sixth flat tube group is communicatingly connected to a cooling fluid outlet. With such an embodiment, it is also possible to achieve a significant reduction of the temperature spread between left and right side (y-direction) and thus an altogether more homogenous temperature distribution.

With such an embodiment, a temperature spread between right and left to a cooling fluid inlet temperature of 107° C. could already be reduced to 2.4° C., as a result of which a comparatively homogenous temperature distribution is achieved.

Practically, all six flat tube groups comprise an at least almost identical flow cross section. Because of this, a particularly low-resistant flow through the heat exchanger can be achieved since no cross-sectional changes occur in the region of the flat tube groups.

In an alternative embodiment of the solution according to the invention having four flow paths and two rows of flat tubes it is provided that the cooling fluid again flows in the first flat tube group in the z-direction, wherein the first flat tube group arranged in a middle region (in y-direction) is communicatingly connected via the upper collecting tank to a second flat tube group arranged in the y-direction in the first row next to the first flat tube group and a third flat tube group arranged counter to the y-direction next to the first flat tube group arranged in the middle region arranged in the first row, wherein the cooling fluid in the second flat tube group and in the third flat tube group flows counter to the z-direction. The second flat tube group is communicatingly connected via the lower collecting tank to a fourth flat tube group arranged counter to the x-direction in the second row, in which the cooling fluid flows in the z-direction, while the third flat tube group is communicatingly connected via the lower collecting tank to a fifth flat tube group arranged counter to the x-direction in the second row, in which the cooling fluid flows in the z-direction. The fourth flat tube group is communicatingly connected via the upper collecting tank to a sixth flat tube group arranged counter to the y-direction alongside in the second row, in which the cooling fluid flows counter to the z-direction, wherein the fifth flat tube group is communicatingly connected via the upper collecting tank with the sixth flat tube group arranged in the y-direction in the second row, in which the cooling fluid flows counter to the z-direction. Finally, the sixth flat tube group is communicatingly connected to a cooling fluid outlet.

In such an embodiment, a temperature spread between right and left to a cooling fluid inlet temperature of 107° C. could be reduced to 0° C., as a result of which an absolutely homogenous temperature distribution is achieved.

In a further alternative embodiment of the solution according to the invention having six flow paths and two rows of flat tubes it is provided that the cooling fluid in the first flat tube group arranged in a middle region flows in the z-direction and that the first flat tube group is communicatingly connected via the upper collecting tank to a second flat tube group arranged in the first row next to the first flat tube group and a third flat tube group arranged counter to the y-direction next to the first flat tube group in the first row, wherein the cooling fluid in the second flat tube group and in the third flat tube group flows counter to the z-direction. In this case, the second flat tube group is communicatingly connected via the lower collecting tank to a fourth flat tube group arranged in the y-direction in the first row next to the second flat tube group, in which the cooling fluid flows in the z-direction, while the third flat tube group is communicatingly connected via the lower collecting tank to a fifth flat tube group arranged counter to the y-direction in the first row next to the third flat tube group, in which the cooling fluid flows in the z-direction. The fourth flat tube group is communicatingly connected via the upper collecting tank to a sixth flat tube group arranged counter to the x-direction in the second row, in which the cooling fluid flows counter to the z-direction and the fifth flat tube group is communicatingly connected via the upper collecting tank to a seventh flat tube group arranged counter to the x-direction in the second row, in which the cooling fluid flows counter to the z-direction. The sixth flat tube group provided with this heat exchanger is communicatingly connected via the lower collecting tank to an eighth flat tube group arranged counter to the y-direction alongside in the second row, in which the cooling fluid flows in the z-direction, wherein the seventh flat tube group is communicatingly connected via the lower collecting tank to a ninth flat tube group arranged in the y-direction alongside in the second row, in which the cooling fluid flows in the z-direction. In addition, the eighth flat tube group is still communicatingly connected via the upper collecting tank to a tenth flat tube group arranged against the y-direction alongside in the second row, in which the cooling fluid flows counter to the z-direction, and the ninth flat tube group is communicatingly connected via the upper collecting tank with the tenth flat tube group arranged in the y-direction alongside in the second row, in which the cooling fluid flows counter to the z-direction. In the second row, the tenth flat tube group is arranged in the y-direction between the ninth flat tube group and the eighth flat tube group, wherein the tenth flat tube group is communicatingly connected to a cooling fluid outlet.

In such an embodiment, a temperature spread between right and left to a cooling fluid inlet temperature of 107° C. could be reduced to 0° C., as a result of which an absolutely homogenous temperature distribution is achieved.

In a further alternative embodiment of the solution according to the invention having six flow paths and three rows, a third row of flat tubes is provided, wherein the second row of flat tubes is arranged in the x-direction between the third first row of flat tubes and the first row of flat tubes. The cooling fluid again flows in the first flat tube group arranged in the middle region in the z-direction, wherein the first flat tube group is communicatingly connected via the upper collecting tank to a second flat tube group arranged in the y-direction in the first row next to the first flat tube group and a third flat tube group arranged counter to the y-direction next to the first flat tube group in the first row, in which the cooling fluid flows counter to the z-direction. The second flat tube group in this case is communicatingly connected via the lower collecting tank to a fourth flat tube group arranged counter to the x-direction in the second row, in which the cooling fluid flows in the z-direction, while the third flat tube group is communicatingly connected via the lower collecting tank to a fifth flat tube group arranged counter to the x-direction in the second row, in which the cooling fluid flows in the z-direction. Further, the fourth flat tube group is communicatingly connected via the upper collecting tank to a sixth flat tube group arranged counter to the y-direction alongside in the second row, in which the cooling fluid flows counter to the z-direction, and the fifth flat tube group is communicatingly connected via the upper collecting tank with the sixth flat tube group arranged in the y-direction alongside in the second row, in which the cooling fluid flows counter to the z-direction. In addition, the sixth flat tube group is communicatingly connected via the lower collecting tank to a seventh flat tube group arranged counter to the x-direction in the third row, in which the cooling fluid flows in the z-direction, and the seventh flat tube group is communicatingly connected via the upper collecting tank to an eighth flat tube group arranged in the y-direction alongside in the third row and to a ninth flat tube group arranged counter to the y-direction in the third row, in which the cooling fluid flows counter to the z-direction. The eighth flat tube group and the ninth flat tube group in this embodiment are communicatingly connected to the cooling fluid outlet.

In this three-row embodiment, a temperature spread between right and left to a cooling fluid inlet temperature of 107° C. can be reduced to 0° C., as a result of which an absolutely homogenous temperature distribution is also achieved here.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention. Constituent parts of a higher unit mentioned above and still to be named in the following, such as for example an installation, a device or an arrangement which are referred to separately, can form separate components of this unit or be integral regions or portions of this unit even if this is shown otherwise in the drawings.

Preferred exemplary embodiments of the invention are shown in the drawings and are explained in more detail in the following description, wherein same reference numbers relate to same or similar or functionally same components. It shows, in each case schematically FIG. 1 a view of a two-row heat exchanger with flow arrows corresponding to the prior art, FIG. 2 a sectional representation along the section plan A-A from FIG. 1, FIG. 3 a view of a two-row heat exchanger according to the invention with flow arrows, FIG. 4 a sectional representation along the section plane A-A from FIG. 3, FIG. 5 a view of a further two-row heat exchanger according to the invention with flow arrows, FIG. 6 a sectional representation along the section plane A-A from FIG. 5, FIG. 7 a view of a further two-row heat exchanger according to the invention with flow arrows, FIG. 8 a sectional representation along the section plane A-A from FIG. 7, FIG. 9 a view of a two-row heat exchanger according to the invention with flow arrows, FIG. 10 a sectional representation along the section plane A-A from FIG. 9, FIG. 11 a diagram for illustrating the improvement of a differential temperature between right and left.

Figure 2:
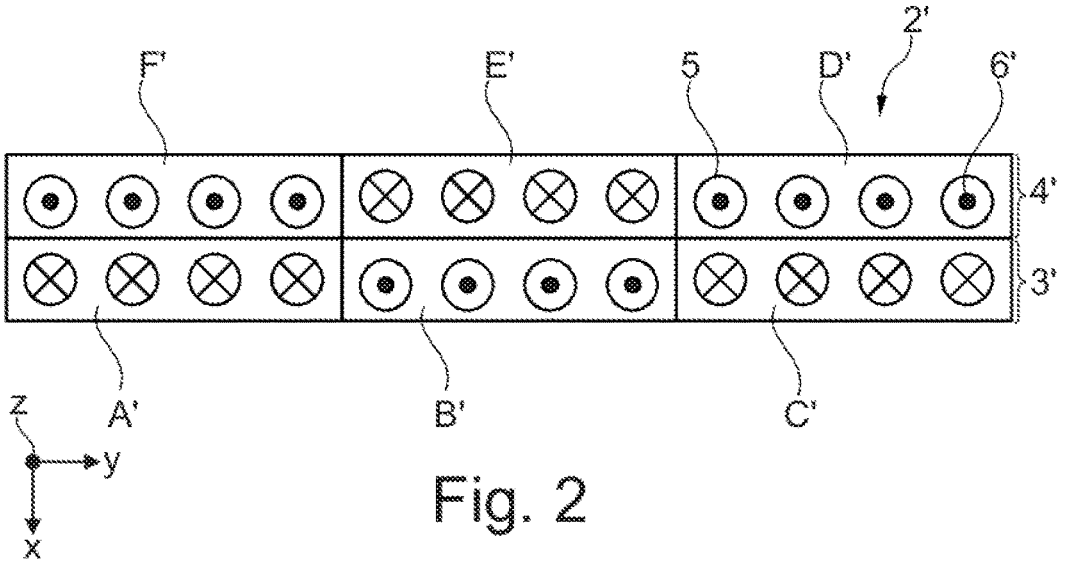

According to FIGS. 1 and 2, a heat exchanger 2' that is not according to the invention and can be flowed through by air 1' in the x-direction is shown, wherein the x-direction, the y-direction and the z-direction relate to the heat exchanger 2'. The heat exchanger 2' ascribable to the prior art comprises a first row 3' of flat tubes 5' and a second row 4' of flat tubes 5' arranged in the x-direction before, wherein the flat tubes 5' are oriented to a longitudinal axis in the z-direction based on the heat exchanger 2' and can be flowed through by a cooling fluid 6'. Furthermore, the heat exchanger 2' has a in the z-direction upper collecting tank 7' and a lower collecting tank 8', wherein the flat tubes 5' in each row 3', 4' are divided in the y-direction based on the heat exchanger 2' into at least three flat tube groups A', B', C', D', E', F' and wherein all flat tubes 5' of a flat tube group A', B', C', D', E', F' are flowed through in the same direction. A cooling fluid inlet of the heat exchanger 2' is communicatingly connected to a in the y-direction outer first flat tube group A' of the first row 3', which according to the diagram shown in FIG. 11 results in a very high temperature spread $\Delta T_{left\text{-}right}$ of −8.3° C. between left and right based on the y-direction.

In the sectional representation A-A in FIG. 2, a dot in a flat tube 5' signifies a flow of the cooling fluid 6' into the sheet plane, while a cross in a flat tube 5' represents a flow of the cooling fluid 6' out of the sheet plane. The term "cooling fluid" 6 is to not only include pure cooling fluids but also other liquids, such as for example a refrigerant, so that the heat exchanger 2' can also be operated as heat pump in an air-conditioning system 9' of a motor vehicle 10'.

A heat exchanger 2' serving as heat pump has the major advantage in particular in electric vehicles that the same, compared with a PTC heating element, lowers an energy consumption and thus increases the range.

Because of the large temperature spread $\Delta T_{left\text{-}right}$ the heat exchangers 2' known from the prior art have a poor temperature profile between left and right, in which a region with overheated and undercooled refrigerant is no longer compensated by the air side and is thus directly visible in the air temperature profile. This is disadvantageous in particular in air-conditioning systems with different zones. A capacity is also negatively affected by this. Particularly the peripheral onflow of the heat exchanger 2' via the first flat tube group A', which is communicatingly connected to a cooling fluid inlet 11, results in the large and undesirable temperature spread $\Delta T_{left\text{-}right}$.

In FIGS. 3 to 10, heat exchangers 2 according to the invention are described, in which the temperature spread $\Delta T_{left\text{-}right}$ is significantly smaller (see FIG. 11) and because of this a more homogenous temperature profile can be created, which increases the comfort of the occupants and in particular favours multi-zone air-conditioning systems which require as homogenous as possible a temperature distribution between right and left.

In FIGS. 3 to 10, reference numbers analogous to FIGS. 1 and 2 are used, however without apostrophe.

According to FIGS. 3 to 10, an entry of hot cooling fluid 6 or refrigerant into the heat exchanger 2 takes place in the y-direction in a middle region 14, preferentially in the middle, for reducing a temperature differential $\Delta T_{left\text{-}right}$ between right and left side of a heat exchanger 2 (y-direction). The heat exchanger 2 according to the invention, which can act as heat pump, is flowed through by air 1 analogous to the heat exchanger 2' shown in FIGS. 1 and 2 in the x-direction (usually against the travelling or longitudinal direction) based on the heat exchanger 2 and has at least one first row 3 of flat tubes 5 and a second row 4 of flat tubes 5 arranged beforehand in the x-direction. The flat tubes are oriented with respect to their longitudinal axis in the z-direction (usually height direction) based on the heat exchanger 2 and can be flowed through by a cooling fluid 6 or refrigerant. The term "flat tube 5" is to obviously also include other tube shapes, in particular round tubes.

The heat exchangers 2 shown in FIGS. 3 to 10 have a in the z-direction upper collecting tank 7 and a lower collecting tank 8, wherein the flat tubes 5 in each row in the y-direction based on the heat exchanger 2 are divided into at least three flat tube groups A, B, C, D, E, F. All flat tubes 5 of a flat tube group A, B, C, D, E, F are flowed through in the same direction, wherein a cooling fluid inlet 11 of the heat exchanger 2 is communicatingly connected to a in the y-direction in the middle region 14 arranged first flat tube group A of the first row 3. The cooling fluid inlet 11 can be directly connected to the first flat tube group A by a lateral pipe or indirectly via the lower collecting tank 8 to the first flat tube group A arranged in the middle region 14. A hot zone, which leads through the first flat tube group A, now lies in the middle region 14. Temperature differentials in the flow direction of the air 1 (x-direction) remain unchanged compared with an embodiment according to the prior art. The temperature spread $\Delta T_{left\text{-}right}$ between the left and right half however differ substantially less from one another as is shown in the diagram in FIG. 11.

In an air-conditioning system 9, which in the x-direction comprises two rows 3, 4 of flat tubes 5, these two rows 3, 4 or zones thus have more uniform temperatures. All in all it is possible with the heat exchangers 2 according to the invention to achieve a significant improvement of the temperature profile with respect to the temperature differential between left and right half of the heat exchanger 2 with constant high capacity.

Figure 3:
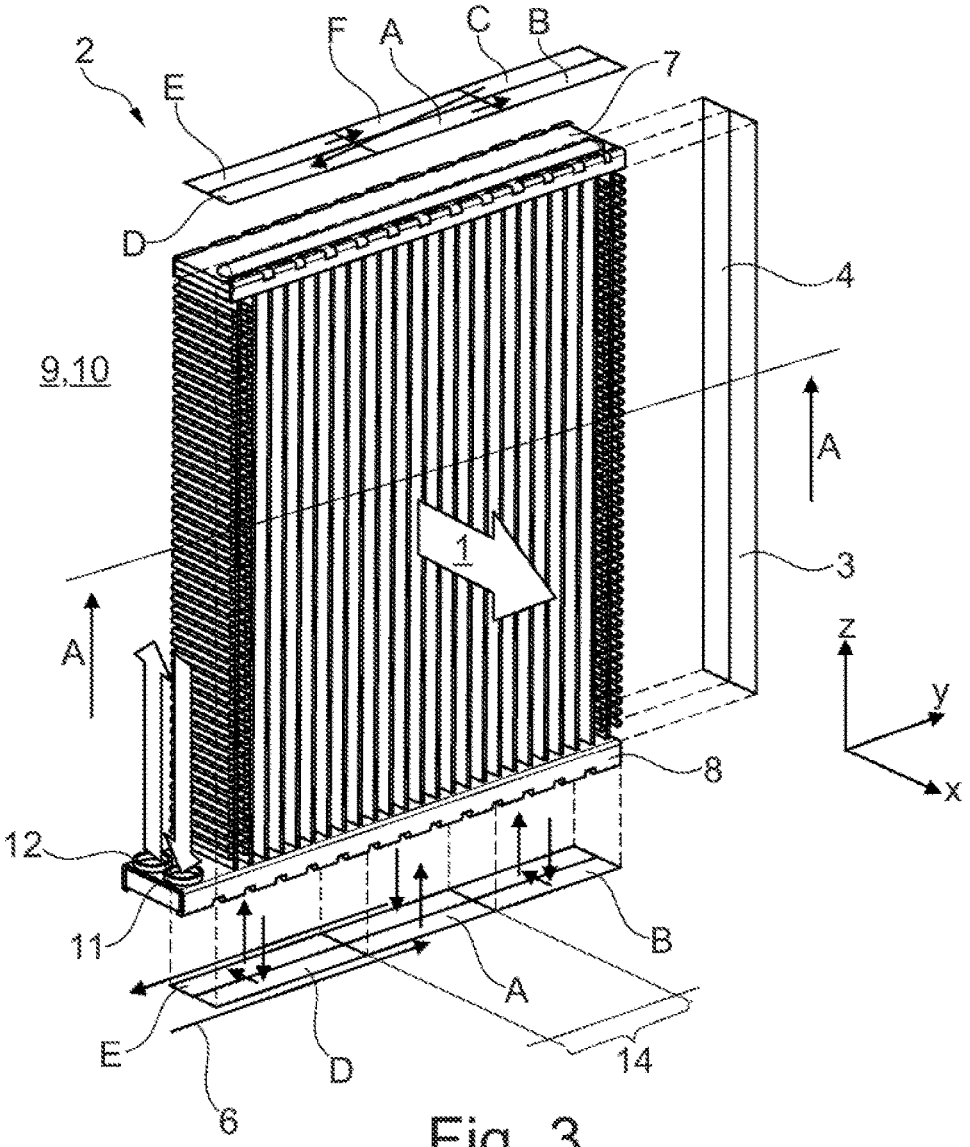
Figure 4:
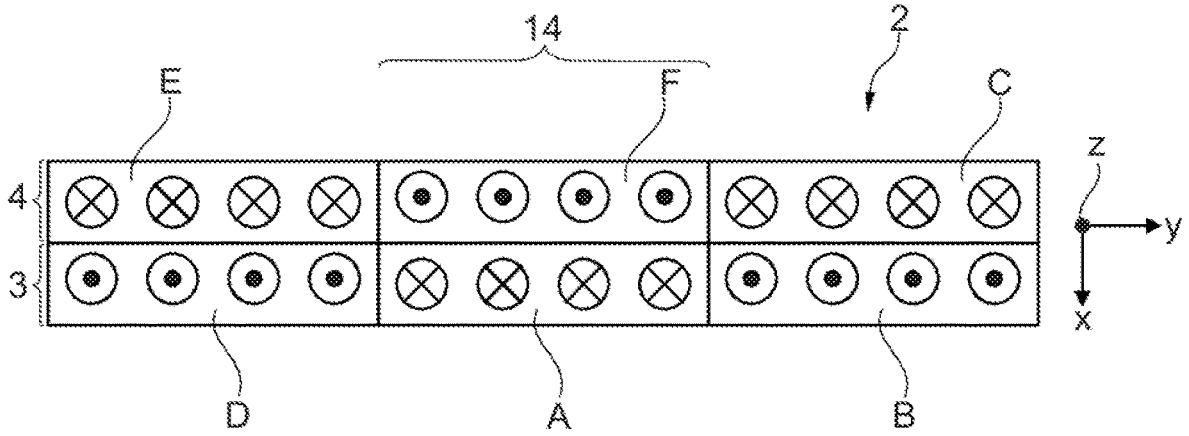

Viewing the heat exchanger 2 according to FIGS. 3 and 4 it is noticeable that the same comprises six flow paths and two rows 3, 4 of flat tube groups A-F, wherein the cooling fluid 6 flows in the first flat tube group A arranged in the middle region 14, preferentially in the middle, in the z-direction and wherein the first flat tube group A is communicatingly connected via the upper collecting tank 7 to a second flat tube group B arranged in the y-direction in the first row 3 next to the first flat tube group A, in which the cooling fluid 6 flows counter to the z-direction.

Figure 11:
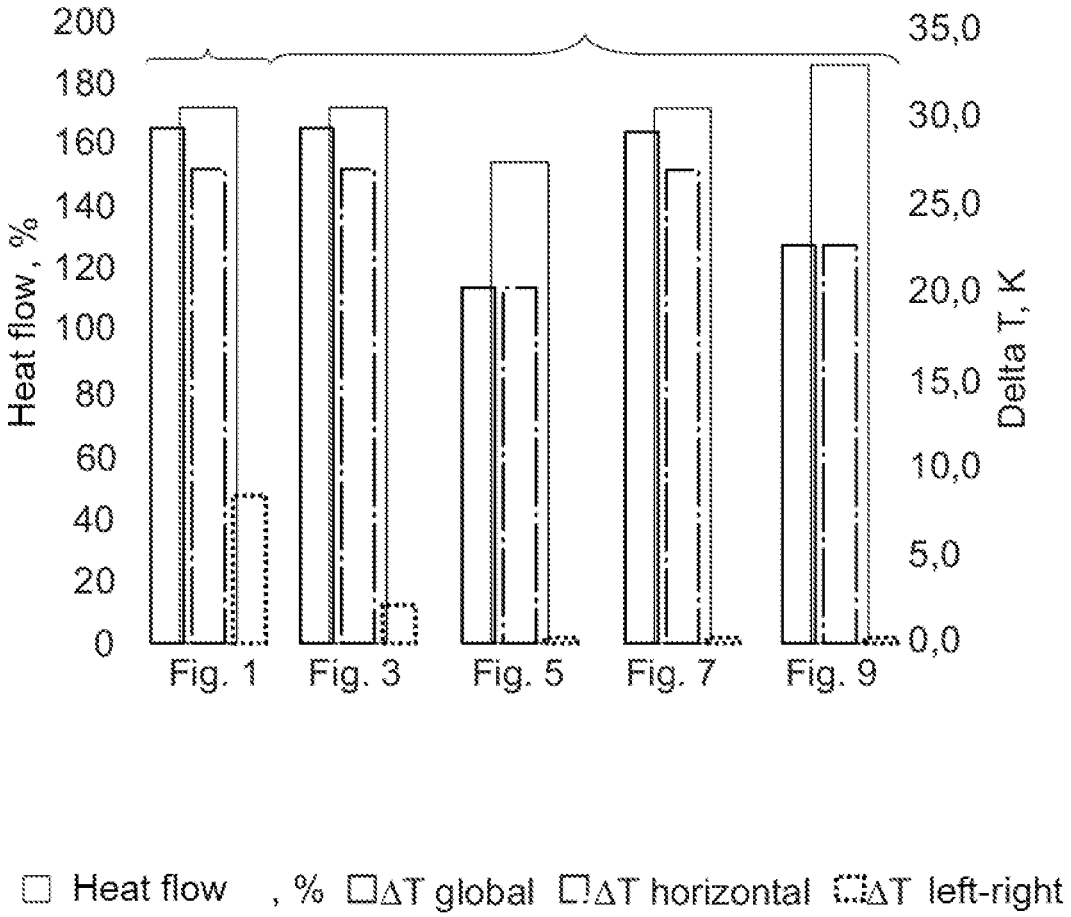

The second flat tube group B is communicatingly connected via the lower collecting tank 8 to a third flat tube group C arranged counter to the x-direction in the second row 4, in which the cooling fluid 6 flows in the z-direction. This third flat tube group C in turn is communicatingly connected to a fourth flat tube group D arranged counter to the y-direction and in the x-direction in the first row 3, in which the cooling fluid flows counter to the z-direction, while the fourth flat tube group D is communicatingly connected via the lower collecting tank 8 to a fifth flat tube group E arranged counter to the x-direction in the second row 4, in which the cooling fluid flows in the z-direction. The fifth flat tube group E is communicatingly connected via the upper collecting tank 7 to a sixth flat tube group F arranged in the y-direction in the second row 4 next to the fifth flat tube group E, in which the cooling fluid 6 flows counter to the z-direction, wherein the sixth flat tube group F is communicatingly connected to a cooling fluid outlet 12. With such an embodiment, a significant reduction of the temperature spread $\Delta T_{left\text{-}right}$ can be achieved between left and right side (y-direction) and thus an altogether more homogenous temperature distribution can be achieved. The temperature spread $\Delta T_{left\text{-}right}$ in the embodiment shown according to FIGS. 3 and 4 at a cooling fluid inlet temperature of 107° C. according to FIG. 11 is merely at 2.4° C.

Practically, all six flat tube groups A, B, C, D, E, F have an at least almost identical flow cross section. Because of this, a particularly low-resistance flow in the heat exchanger 2 can be achieved since no cross-sectional changes occur in the region of the flat tube groups A, B, C, D, E, F.

Figure 5:
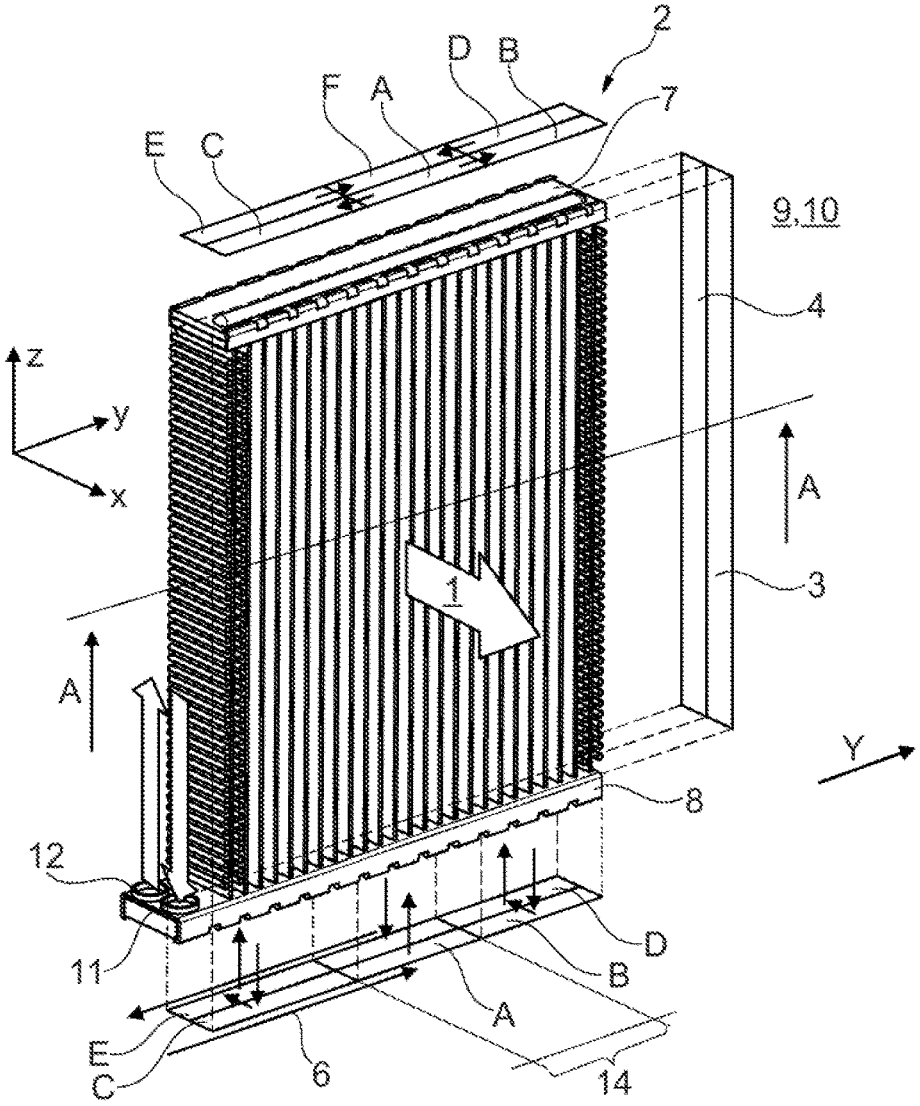
Figure 6:
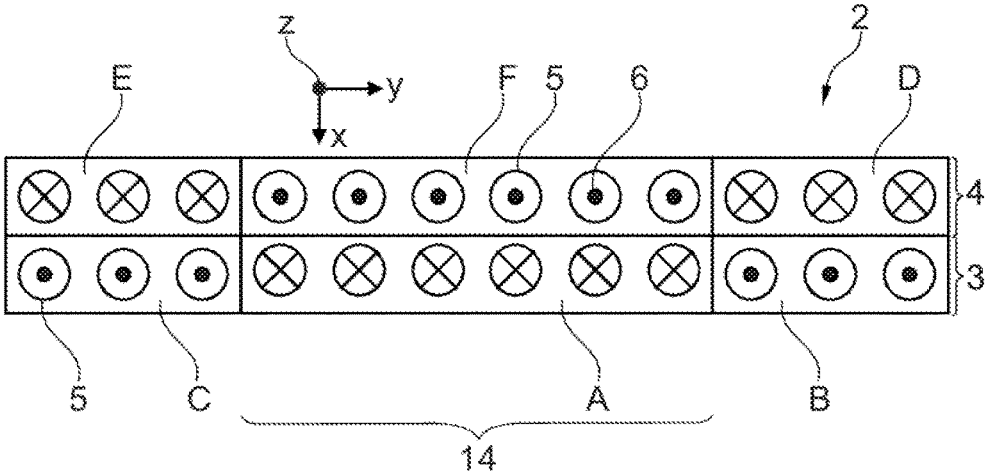

In an alternative embodiment according to FIGS. 5 and 6, the heat exchanger 2 comprises four flow paths and two rows 3, 4 of flat tubes 5, wherein the cooling fluid 6 in turn flows in the first flat tube group A in the z-direction. In the first flat tube group A, the cooling fluid 6 is thus, not only in this case, introduced at the bottom and flows upwards in the z-direction. The first flat tube group A arranged in the middle region 14 is communicatingly connected via the upper collecting tank 7 to a second flat tube group B arranged in the Y-direction in the first row 3 next to the first flat tube group A and a third flat tube group C arranged counter to the y-direction next to the first flat tube group A in the first row 3, wherein the cooling fluid 6 in the second flat tube group B and in the third flat tube group C flows counter to the z-direction, i.e. normally downwards. The second flat tube group B is communicatingly connected via the lower collecting tank 8 to a fourth flat tube group D arranged counter to the x-direction in the second row 4, in which the cooling fluid 6 flows in the z-direction, while the third flat tube group C is communicatingly connected via the lower collecting tank 8 to a fifth flat tube group E arranged counter to the x-direction in the second row 4, in which the cooling fluid 6 flows in the z-direction. The fourth flat tube group D is communicatingly connected via the upper collecting tank 7 to a sixth flat tube group F arranged counter to the y-direction alongside in the second row 4, in which the cooling fluid 6 flows counter to the z-direction, wherein the fifth flat tube E group is likewise communicatingly connected via the upper collecting tank 7 with the sixth flat tube group F arranged in the y-direction in the second row 4, in which the cooling fluid 6 flows counter to the z-direction. Finally, the sixth flat tube group F is communicatingly connected to a cooling fluid outlet 12. The cooling fluid outlet is thus located likewise at the bottom.

In such an embodiment, a temperature spread $\Delta T_{left\text{-}right}$ between right and left at a cooling fluid inlet temperature of 107° C. could be reduced to 0° C., as a result of which an absolutely homogenous temperature distribution is achieved.

Figure 7:
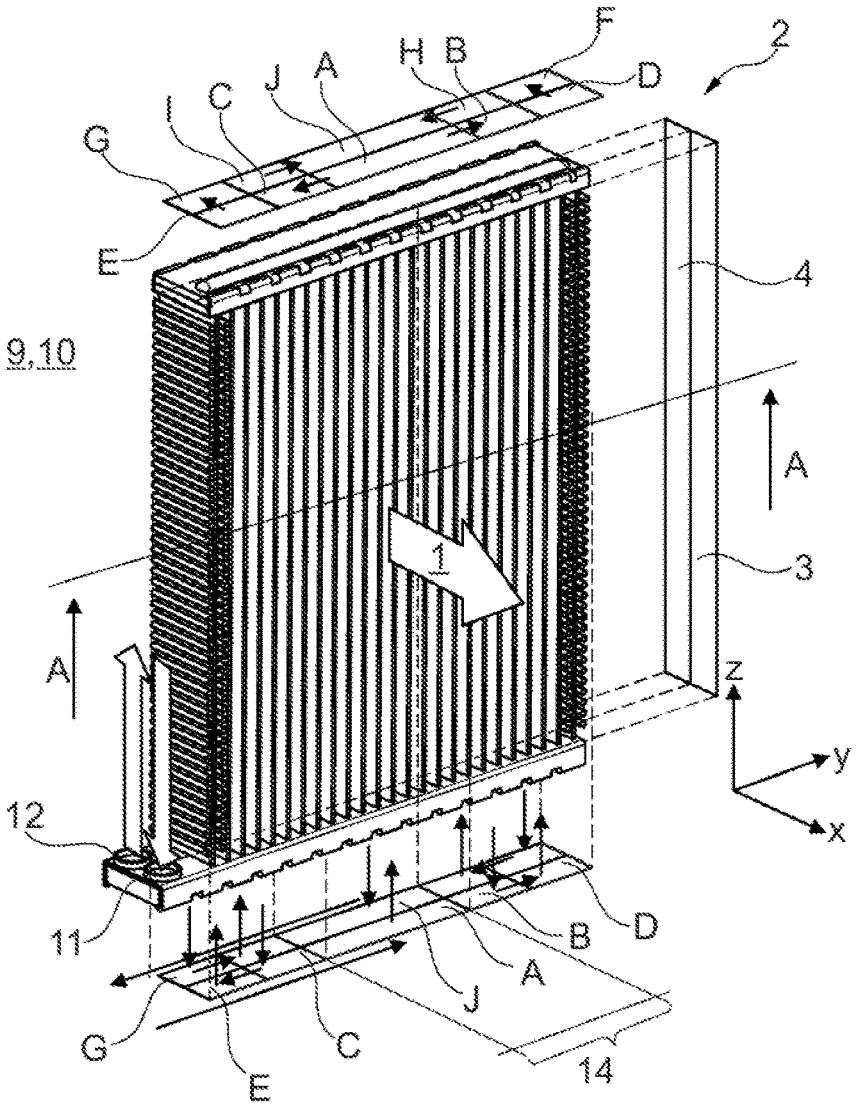
Figure 8:
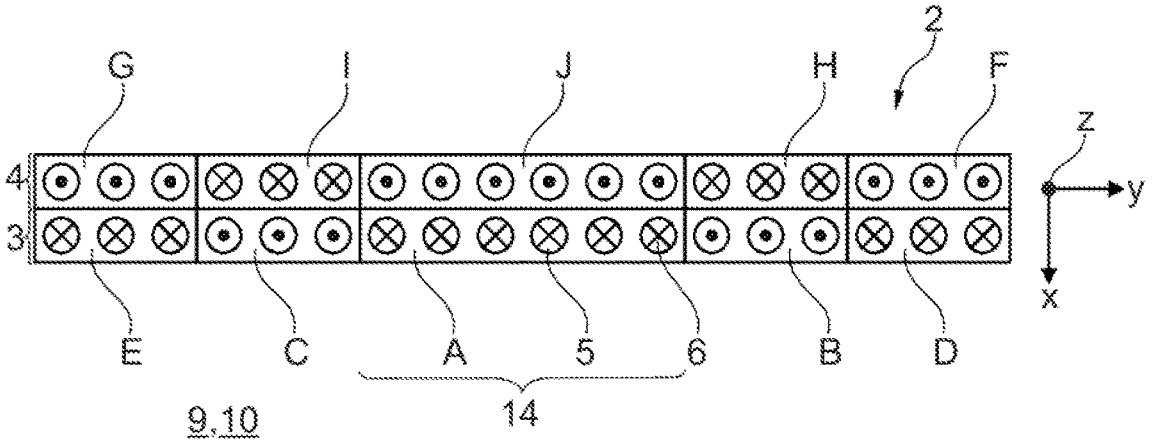

In a further alternative embodiment of the solution according to the invention, as the same is shown in FIGS. 7 and 8, the heat exchanger 2 comprises two rows 3, 4 of flat tubes 5, wherein the cooling fluid 6 flows in the first flat tube group A in the z-direction and the first flat tube group A is communicatingly connected via the upper collecting tank 7 to a second flat tube group B arranged in the y-direction in the first row 3 next to the first flat tube group A and a third flat tube group C arranged counter to the y-direction next to the first flat tube group A arranged in the middle region 14 arranged in the first row 3, in which the cooling fluid 6 flows counter to the z-direction. In this case, the second flat tube group B is communicatingly connected to a fourth flat tube group D arranged in the y-direction in the first row 3 next to the second flat tube group B in which the cooling fluid 6 flows in the z-direction, while the third flat tube group C is communicatingly connected via the lower collecting tank 8 to a fifth flat tube group E arranged counter to the y-direction in the first row 3 next to the third flat tube group C, in which the cooling fluid 6 flows in the z-direction. The fourth flat tube group D in turn is communicatingly connected via the upper collecting tank 7 to a sixth flat tube group F arranged counter to the x-direction in the second row 4, in which the cooling fluid 6 flows counter to the z-direction, and the fifth flat tube group E is communicatingly connected via the upper collecting tank 7 to a seventh flat tube group G arranged counter to the x-direction in the second row 4, in which the cooling fluid 6 flows counter to the z-direction. The sixth flat tube group F provided in this heat exchanger 2 is communicatingly connected via the lower collecting tank 8 to an eighth flat tube group H arranged counter to the y-direction alongside in the second row 4, in which the cooling fluid 6 flows in the z-direction, wherein the seventh flat tube group G is communicatingly connected via the lower collecting tank 8 to a ninth flat tube group I arranged in the y-direction alongside in the second row 4, in which the cooling fluid 6 flows in the z-direction. In addition, the eighth flat tube group H is additionally communicatingly connected via the upper collecting tank 7 to a tenth flat tube group J arranged counter to the y-direction alongside in the second row 4, in which the cooling fluid 6 flows counter to the z-direction, and the ninth flat tube group I is communicatingly connected via the upper collecting tank 7 with the tenth flat tube group J arranged in the y-direction alongside in the second row 4, in which the cooling fluid 6 flows counter to the z-direction to the cooling fluid outlet 12. In the second row 4, the tenth flat tube group J is arranged in the y-direction between the ninth flat tube group I and the eighth flat tube group H, wherein the tenth flat tube group J is communicatingly connected to the cooling fluid outlet 12.

The first flat tube group A and the tenth flat tube group J have a 0.7 to 1.3-fold, in particular, identical flow cross section, while the remaining flat tube group B, C, D, E, F, G, H and I have a 0.7 to 1.3-fold, in particular, identical flow cross section.

In such an embodiment, a temperature spread $\Delta T_{left\text{-}right}$ between right and left to a cooling fluid inlet temperature of 107° C. could be reduced to 0° C. (see FIG. 11), as a result of which even to a significantly higher cooling fluid inlet temperature, an absolutely homogenous temperature distribution can be achieved.

Figure 9:
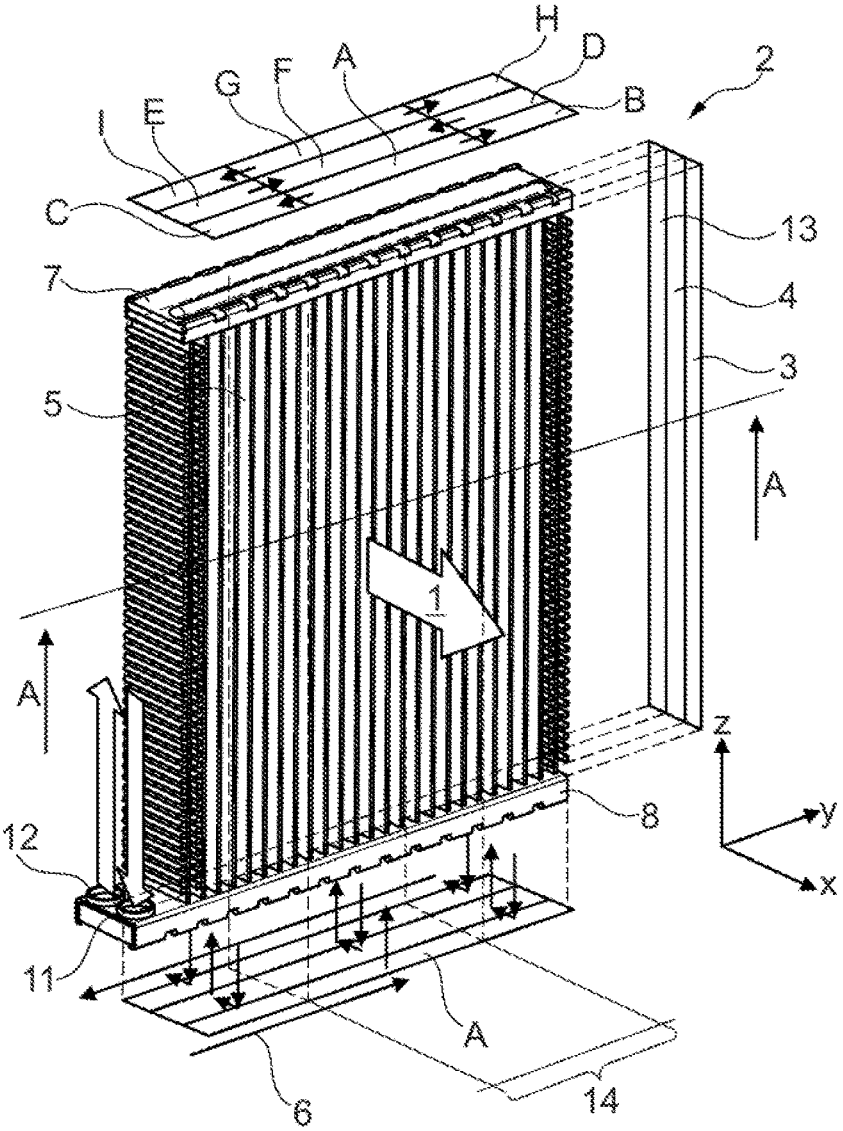
Figure 10:
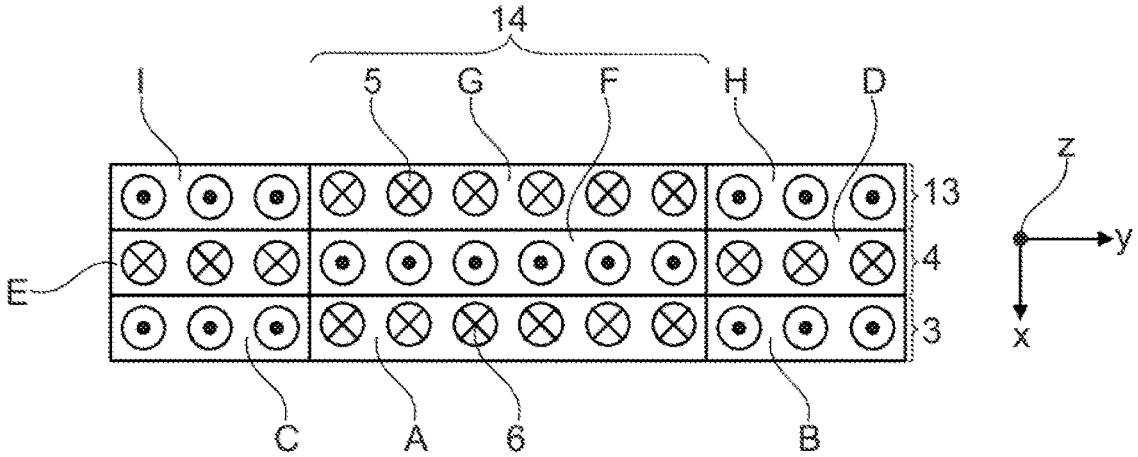

The heat exchanger 2 shown in FIGS. 9 and 10 comprises a third row 13 of flat tubes 5, wherein the second row 4 of flat tubes 5 is arranged in the x-direction between the third row 13 of flat tubes 5 and the first row 3 of flat tubes 5. The cooling fluid 6 in turn flows in the first flat tube group A arranged in the middle region 14, which is connected to the cooling fluid inlet 11, in the z-direction, wherein the first flat tube group A is communicatingly connected via the upper collecting tank 7 to a second flat tube group B arranged in the y-direction in the first row 3 next to the first flat tube group A and a third flat tube group C arranged counter to the y-direction next to the first flat tube group A in the first row 3, in which the cooling fluid 6 flows counter to the z-direction. The second flat tube group B in this case is communicatingly connected via the lower collecting tank 8 to a fourth flat tube group D arranged counter to the x-direction in the second row 4, in which the cooling fluid 6 flows in the z-direction, while the third flat tube group C is communicatingly connected via the lower collecting tank 8 to a fifth flat tube group E arranged counter to the x-direction in the second row 4, in which the cooling fluid 6 flows in the z-direction. Further, the fourth flat tube group D is communicatingly connected via the upper collecting tank 7 to a sixth flat tube group F arranged counter to the y-direction alongside in the second row 4, in which the cooling fluid 6 flows counter to the z-direction, and the fifth flat tube group E is likewise communicatingly connected via the upper collecting tank 7 with the sixth flat tube group F arranged in the y-direction alongside in the second row 4. In addition, the sixth flat tube group F is communicatingly connected via the lower collecting tank 8 to a seventh flat tube group G arranged counter to the x-direction in the third row 13, in which the cooling fluid 6 flows in the z-direction, and the seventh flat tube group G is communicatingly connected via the upper collecting tank 8 to an eighth flat tube group H arranged in the y-direction alongside in the third row 13 and to a ninth flat tube group I arranged counter to the y-direction in the third row 13, in which the cooling fluid 6 in each case flows counter to the z-direction. The eighth and ninth flat tube group H, I in this embodiment are communicatingly connected to the cooling fluid outlet 12.

In this three-row embodiment, a temperature spread $\Delta T_{left\text{-}right}$ according to FIG. 11 between right and left to a cooling fluid inlet temperature of 107° C. can be reduced to 0° C., as a result of which an absolutely homogenous temperature distribution is achieved here.

Viewing FIGS. 9 and 10 further it is noticeable that the first flat tube group A, the sixth flat tube group F and the seventh flat tube group G have a 0.7 to 1.3-fold, in particular, identical flow cross section. In addition or alternatively, the second flat tube group B, the third flat tube group C, the fourth flat tube group D, the fifth flat tube group E, the eighth flat tube group H and the ninth flat tube group I can have a 0.7 to 1.3-fold, in particular, identical flow cross section.

Further it is noticeable that the first flat tube group A, the sixth flat tube group F and the seventh flat tube group G each have twice as large a flow cross section as the second flat tube group B, the third flat tube group C, the fourth flat tube group D, the fifth flat tube group E, the eighth flat tube group H and the ninth flat tube group I. The first flat tube group A, the sixth flat tube group F and the seventh flat tube group G can each have 1.5 to 2.5 times as large a flow cross section as the second flat tube group B, the third flat tube group C, the fourth flat tube group D, the fifth flat tube group E, the eighth flat tube group H and the ninth flat tube group I.

All in all, it is possible with the heat exchangers 2 according to the invention to significantly reduce a temperature spread $\Delta T_{left\text{-}right}$ (see FIG. 11) and thereby create a more homogenous temperature profile, which increases the comfort of the occupants and in particular favours multi-zone air-conditioning systems which require as homogenous as possible a temperature distribution between right and left.

The specification can be best understood with reference to the following Numbered Paragraphs:Numbered Paragraph 1. A heat exchanger (2) that can be flowed through by air (1) in the x-direction based on the heat exchanger (2), having at least one first row (3) of flat tubes (5) and a second row (4) of flat tubes (5) arranged beforehand in the x-direction, wherein the flat tubes (5) are oriented in the z-direction based on the heat exchanger (2) and can be flowed by a cooling fluid (6), having an upper collecting tank (7) and a lower collecting tank (8) in the z-direction, wherein the flat tubes (5) in each row (3, 4) are divided in the y-direction based on the heat exchanger (2) into at least three flat tube groups (A, B, C, D, E, F, G, H, I, J), wherein all flat tubes (5) of a flat tube group (A, B, C, D, E, F, G, H, I, J) are flowed through in the z-direction, wherein a cooling fluid inlet (11) of the heat exchanger (2) is communicatingly connected to a first flat tube group (A) of the first row (3) arranged in the y-direction in a middle region (14).

Numbered Paragraph 2. The heat exchanger according to Numbered Paragraph 1, characterized, in that the cooling fluid (6) flows in the first flat tube group (A) in the z-direction, in that the first flat tube group (A) is communicatingly connected via the upper collecting tank (7) to a second flat tube group (B) arranged in the y-direction in the first row (3) next to the first flat tube group (A), in which the cooling fluid (6) flows counter to the z-direction, in that the flat tube group (B) is communicatingly connected via the lower collecting tank (8) to a third flat tube group (C) arranged counter to the x-direction in the second row (4), in which the cooling fluid (6) flows in the z-direction, in that the third flat tube group (C) is communicatingly connected via the upper collecting tank (7) to a fourth flat tube group (D) arranged counter to the y-direction and in the x-direction in the first row (3), in which the cooling fluid (6) flows counter to the z-direction, in that the fourth flat tube group (D) is communicatingly connected via the lower collecting tank (8) to a fifth flat tube group (E) arranged counter to the x-direction in the second row (4), in which the cooling fluid (6) flows in the z-direction, in that the fifth flat tube group (E) is communicatingly connected via the upper collecting tank (7) to a sixth flat tube group (F) arranged in the y-direction in the second row (4) next to the fifth flat tube group (E), in which the cooling fluid (6) flows counter to the z-direction, in that the sixth flat tube group (F) is communicatingly connected to a cooling fluid outlet (12).

Numbered Paragraph 3. The heat exchanger according to Numbered Paragraph 2, characterized in that all six flat tube groups (A, B, C, D, E, F, G, H, I, J) have an at least almost identical flow cross section.

Numbered Paragraph 4. The heat exchanger according to Numbered Paragraph 1, characterized, in that the cooling fluid (6) flows in the first flat tube group (A) in the z-direction, in that the first flat tube group (A) is communicatingly connected via the upper collecting tank (7) to a second flat tube group (B) arranged in the y-direction in the first row (3) next to the first flat tube group (A) and a third flat tube group (C) arranged counter to the y-direction next to the first flat tube group (A) in the first row (3), wherein the cooling fluid in the second flat tube group (B) and in the third flat tube group (C) flows counter to the z-direction, in that the second flat tube group (B) is communicatingly connected via the lower collecting tank (8) to a fourth flat tube group (D) arranged counter to the x-direction in the second row (4), in which the cooling fluid (6) flows in the z-direction, in that the third flat tube group (C) is communicatingly connected via the lower collecting tank (8) to a fifth flat tube group (E) arranged counter to the x-direction in the second row (4), in which the cooling fluid (6) flows in the z-direction, in that the fourth flat tube group (D) is communicatingly connected via the upper collecting tank (7) to a sixth flat tube group (F) arranged counter to the y-direction alongside in the second row (4), in which the cooling fluid (6) flows counter to the z-direction, in that the fifth flat tube group (E) is communicatingly connected via the upper collecting tank (7) with the sixth flat tube group (F) arranged in the y-direction in the second row (4), in that the sixth flat tube group (F) is communicatingly connected to a cooling fluid outlet (12).

Numbered Paragraph 5. The heat exchanger according to Numbered Paragraph 4, characterized in that the first flat tube group (A) and the sixth flat tube group (F) each have a cross section that is 1.5 to 2.5 times that of the flat tube group (B), the third flat tube group (C), the fourth flat tube group (D) and the fifth flat tube group (E).

Numbered Paragraph 6. The heat exchanger according to Numbered Paragraph 1, characterized, in that the cooling fluid (6) in the first flat tube group (A) flows in the z-direction, in that the first flat tube group (A) is communicatingly connected via the upper collecting tank (7) to a second flat tube group (B) arranged in the y-direction in the first row (3) next to the first flat tube group (A) and a third flat tube group (C) arranged counter to the y-direction next to the first flat tube group (A) in the first row (3), wherein the cooling fluid in the second flat tube group (B) and in the third flat tube group (C) flows counter to the z-direction, in that the second flat tube group (B) is communicatingly connected via the lower collecting tank (8) to a fourth flat tube group (D) arranged in the y-direction in the first row (3) next to the second flat tube group (B), in which the cooling fluid (6) flows in the z-direction, in that the third flat tube group (C) is communicatingly connected via the lower collecting tank (8) to a fifth flat tube group (E) arranged counter to the y-direction in the first row (3) next to the third flat tube group (C), in which the cooling fluid (6) flows in the z-direction, in that the fourth flat tube group (D) is communicatingly connected via the upper collecting tank (7) to a sixth flat tube group (F) arranged counter to the x-direction in the second row (4), in which the cooling fluid (6) flows counter to the z-direction, in that the fifth flat tube group (E) is communicatingly connected via the upper collecting tank (7) to a seventh flat tube group (G) arranged counter to the x-direction in the second row (4), in which the cooling fluid (6) flows counter to the z-direction, in that the sixth flat tube group (F) is communicatingly connected via the lower collecting tank (8) to an eighth flat tube group (H) arranged counter to the y-direction alongside in the second row (4), in which the cooling fluid (6) flows in the z-direction, in that the seventh flat tube group (G) is communicatingly connected via the lower collecting tank (8) to a ninth flat tube group (I) arranged in the y-direction alongside in the second row (4), in which the cooling fluid (6) flows in the z-direction, in that the eighth flat tube group (H) is communicatingly connected via the upper collecting tank (7) to a tenth flat tube group (J) arranged counter to the y-direction alongside in the second row (4), in which the cooling fluid (6) flows counter to the z-direction, in that the ninth flat tube group (I) is communicatingly connected via the upper collecting tank (7) to a tenth flat tube group (J) arranged in the y-direction alongside in the second row (4), in which the cooling fluid (6) flows counter to the z-direction, in that in the second row (4) the tenth flat tube group (J) is arranged in the y-direction between the ninth flat tube group (I) and the eighth flat tube group (H), in that the tenth flat tube group (J) is communicatingly connected to a cooling fluid outlet (12).

Numbered Paragraph 7. The heat exchanger according to Numbered Paragraph 6, characterized in that the first flat tube group (A) and the tenth flat tube group (J) each have a flow cross section that is 1.5 to 2.5 times as large as the second flat tube group (B), the third flat tube group (C), the fourth flat tube group (D), the fifth flat tube group (E), the sixth flat tube group (F), the seventh flat tube group (G), the eighth flat tube group (H) and the ninth flat tube group (I).

Numbered Paragraph 8. The heat exchanger according to Numbered Paragraph 1, characterized in that a third row (13) of flat tubes (5) is provided, wherein the second row (4) of flat tubes (5) is arranged in the x-direction between the third row (13) of flat tubes (5) and the first row (3) of flat tubes (5).

Numbered Paragraph 9. The heat exchanger according to Numbered Paragraph 8, characterized, in that the cooling fluid (6) in the first flat tube group (A) flows in the z-direction, in that the first flat tube group (A) is communicatingly connected via the upper collecting tank (7) to a second flat tube group (B) arranged in the y-direction in the first row (3) next to the first flat tube group (A) and a third flat tube group (C) arranged counter to the y-direction next to the first flat tube group (A) in the first row (3), in which the cooling fluid (6) flows counter to the z-direction, in that the second flat tube group (B) is communicatingly connected via the lower collecting tank (8) to a fourth flat tube group (D) arranged counter to the x-direction in the second row (4), in which the cooling fluid (6) flows in the z-direction, in that the third flat tube group (C) is communicatingly connected via the lower collecting tank (8) to a fifth flat tube group (E) arranged counter to the x-direction in the second row (4), in which the cooling fluid (6) flows in the z-direction, in that the fourth flat tube group (D) is communicatingly connected via the upper collecting tank (7) to a sixth flat tube group (F) arranged counter to the y-direction alongside in the second row (4), in which the cooling fluid (6) flows counter to the z-direction, in that the fifth flat tube group (E) is communicatingly connected via the upper collecting tank (7) with the sixth flat tube group (F) arranged in the y-direction alongside in the second row (4), in that the sixth flat tube group (F) is communicatingly connected via the lower collecting tank (8) to a seventh flat tube group (G) arranged counter to the x-direction in the third row (13), in which the cooling fluid (6) flows in the z-direction, in that the seventh flat tube group (G) is communicatingly connected via the upper collecting tank (7) to an eighth flat tube group (H) arranged in the y-direction alongside in the third row (13) and to a ninth flat tube group (I) arranged counter to the y-direction in the third row (13), in which the cooling fluid (6) flows counter to the z-direction, in that the eighth flat tube group (H) and the ninth flat tube group (I) are communicatingly connected to a cooling fluid outlet (12).

Numbered Paragraph 10. The heat exchanger according to Numbered Paragraph 9, characterized, in that the first flat tube group (A), the sixth flat tube group (F) and the seventh flat tube group (G) have a 0.7 to 1.3-fold, in particular, identical flow cross section, and/or in that the second flat tube group (B), the third flat tube group (C), the fourth flat tube group (D), the fifth flat tube group (E), the eighth flat tube group (H) and the ninth flat tube group (I) have a 0.7 to 1.3-fold, in particular, identical cross section.

Numbered Paragraph 11. The heat exchanger according to Numbered Paragraph 9 or characterized in that the first flat tube group (A), the sixth flat tube group (F) and the seventh flat tube group (G) have twice as large a flow cross section as the second flat tube group (B), the third flat tube group (C), the fourth flat tube group (D), the fifth flat tube group (E), the eighth flat tube group (H) and the ninth flat tube group (I).

The invention claimed is:

1. A heat exchanger configured for use with air in an x-direction based on the heat exchanger, comprising, at least one first row of flat tubes and a second row of flat tubes arranged beforehand in the x-direction, wherein the flat tubes are oriented in the z-direction based on the heat exchanger and are configured for use with a cooling fluid, having an upper collecting tank and a lower collecting tank in the z-direction, wherein a cooling fluid inlet and a cooling fluid outlet are connected in series to the lower collecting tank, wherein the cooling fluid inlet and the cooling fluid outlet are both disposed upon a protrusion that extends away from the flat tubes in the y-direction, wherein the cooling fluid inlet and the cooling fluid outlet are configured to allow for fluid flow in a direction parallel to the fluid flow through the flat tubes, wherein the flat tubes in each row are divided in the y-direction based on the heat exchanger into at least three flat tube groups, wherein all flat tubes of a flat tube group are flowed through in the z-direction, and wherein the cooling fluid inlet of the heat exchanger is communicatingly connected to a first flat tube group of the first row arranged in the y-direction in a middle region.

2. The heat exchanger according to claim 1, wherein the cooling fluid flows in the first flat tube group in the z-direction, the first flat tube group is communicatingly connected via the upper collecting tank to a second flat tube group arranged in the y-direction in the first row next to the first flat tube group, in which the cooling fluid flows counter to the z-direction, the flat tube group is communicatingly connected via the lower collecting tank to a third flat tube group arranged counter to the x-direction in the second row, in which the cooling fluid flows in the z-direction, the third flat tube group is communicatingly connected via the upper collecting tank to a fourth flat tube group arranged counter to the y-direction and in the x-direction in the first row, in which the cooling fluid flows counter to the z-direction, the fourth flat tube group is communicatingly connected via the lower collecting tank to a fifth flat tube group arranged counter to the x-direction in the second row, in which the cooling fluid flows in the z-direction, the fifth flat tube group is communicatingly connected via the upper collecting tank to a sixth flat tube group arranged in the y-direction in the second row next to the fifth flat tube group, in which the cooling fluid flows counter to the z-direction, and the sixth flat tube group is communicatingly connected to a cooling fluid outlet.

3. The heat exchanger according to claim 2, wherein each of the first flat tube group, the second flat tube group, the third flat tube group, the fourth flat tube group, the fifth flat tube group and the sixth flat tube group have an at least almost identical flow cross section.

4. The heat exchanger according to claim 1, wherein the cooling fluid flows in the first flat tube group in the z-direction, the first flat tube group is communicatingly connected via the upper collecting tank to a second flat tube group arranged in the y-direction in the first row next to the first flat tube group and a third flat tube group arranged counter to the y-direction next to the first flat tube group in the first row, wherein the cooling fluid in the second flat tube group and in the third flat tube group flows counter to the z-direction, the second flat tube group is communicatingly connected via the lower collecting tank to a fourth flat tube group arranged counter to the x-direction in the second row, in which the cooling fluid flows in the z-direction, the third flat tube group is communicatingly connected via the lower collecting tank to a fifth flat tube group arranged counter to the x-direction in the second row, in which the cooling fluid flows in the z-direction, the fourth flat tube group is communicatingly connected via the upper collecting tank to a sixth flat tube group arranged counter to the y-direction alongside in the second row, in which the cooling fluid flows counter to the z-direction, the fifth flat tube group is communicatingly connected via the upper collecting tank with the sixth flat tube group arranged in the y-direction in the second row, and the sixth flat tube group is communicatingly connected to a cooling fluid outlet.

5. The heat exchanger according to claim 4, wherein the first flat tube group and the sixth flat tube group-each have a cross section that is 1.5 to 2.5 times that of each of the flat tube group, the third flat tube group, the fourth flat tube group and the fifth flat tube group.

6. The heat exchanger according to claim 1, wherein the cooling fluid in the first flat tube group flows in the z-direction, the first flat tube group is communicatingly connected via the upper collecting tank to a second flat tube group arranged in the y-direction in the first row next to the first flat tube group and a third flat tube group arranged counter to the y-direction next to the first flat tube group in the first row, wherein the cooling fluid in the second flat tube group and in the third flat tube group flows counter to the z-direction, the second flat tube group is communicatingly connected via the lower collecting tank to a fourth flat tube group arranged in the y-direction in the first row next to the second flat tube group, in which the cooling fluid flows in the z-direction, the third flat tube group is communicatingly connected via the lower collecting tank to a fifth flat tube group arranged counter to the y-direction in the first row next to the third flat tube group, in which the cooling fluid flows in the z-direction, the fourth flat tube group is communicatingly connected via the upper collecting tank to a sixth flat tube group arranged counter to the x-direction in the second row, in which the cooling fluid flows counter to the z-direction, the fifth flat tube group is communicatingly connected via the upper collecting tank to a seventh flat tube group arranged counter to the x-direction in the second row, in which the cooling fluid flows counter to the z-direction, the sixth flat tube group is communicatingly connected via the lower collecting tank to an eighth flat tube group arranged counter to the y-direction alongside in the second row, in which the cooling fluid flows in the z-direction, the seventh flat tube group is communicatingly connected via the lower collecting tank to a ninth flat tube group arranged in the y-direction alongside in the second row, in which the cooling fluid flows in the z-direction, the eighth flat tube group is communicatingly connected via the upper collecting tank to a tenth flat tube group arranged counter to the y-direction alongside in the second row, in which the cooling fluid flows counter to the z-direction, the ninth flat tube group is communicatingly connected via the upper collecting tank to a tenth flat tube group arranged in the y-direction alongside in the second row, in which the cooling fluid flows counter to the z-direction, the second row the tenth flat tube group is arranged in the y-direction between the ninth flat tube group and the eighth flat tube group, and the tenth flat tube group is communicatingly connected to a cooling fluid outlet.

7. The heat exchanger according to claim 6, wherein the first flat tube group and the tenth flat tube group each have a flow cross section that is 1.5 to 2.5 times as large as each of the second flat tube group, the third flat tube group, the fourth flat tube group, the fifth flat tube group, the sixth flat tube group, the seventh flat tube group, the eighth flat tube group and the ninth flat tube group.

8. The heat exchanger according to claim 1, further comprising a third row of flat tubes, wherein the second row of flat tubes is arranged in the x-direction between the third row of flat tubes and the first row of flat tubes.

9. The heat exchanger according to claim 8, wherein the cooling fluid in the first flat tube group flows in the z-direction, the first flat tube group is communicatingly connected via the upper collecting tank to a second flat tube group arranged in the y-direction in the first row next to the first flat tube group and a third flat tube group arranged counter to the y-direction next to the first flat tube group in the first row, in which the cooling fluid flows counter to the z-direction, the second flat tube group is communicatingly connected via the lower collecting tank to a fourth flat tube group arranged counter to the x-direction in the second row, in which the cooling fluid flows in the z-direction, the third flat tube group is communicatingly connected via the lower collecting tank to a fifth flat tube group arranged counter to the x-direction in the second row, in which the cooling fluid flows in the z-direction, the fourth flat tube group is communicatingly connected via the upper collecting tank to a sixth flat tube group arranged counter to the y-direction alongside in the second row, in which the cooling fluid flows counter to the z-direction, the fifth flat tube group is communicatingly connected via the upper collecting tank with the sixth flat tube group arranged in the y-direction alongside in the second row, the sixth flat tube group is communicatingly connected via the lower collecting tank to a seventh flat tube group arranged counter to the x-direction in the third row, in which the cooling fluid flows in the z-direction, the seventh flat tube group is communicatingly connected via the upper collecting tank to an eighth flat tube group arranged in the y-direction alongside in the third row and to a ninth flat tube group arranged counter to the y-direction in the third row, in which the cooling fluid flows counter to the z-direction, and the eighth flat tube group and the ninth flat tube group are communicatingly connected to a cooling fluid outlet.

10. The heat exchanger according to claim 9, wherein the first flat tube group, the sixth flat tube group and the seventh flat tube group have a 0.7 to 1.3-fold, in particular, identical flow cross section, and/or the second flat tube group, the third flat tube group, the fourth flat tube group, the fifth flat tube group, the eighth flat tube group and the ninth flat tube group have a 0.7 to 1.3-fold, in particular, identical cross section.

11. The heat exchanger according to claim 9, wherein the first flat tube group, the sixth flat tube group and the seventh flat tube group have twice as large a flow cross section as each of the second flat tube group, the third flat tube group, the fourth flat tube group, the fifth flat tube group, the eighth flat tube group and the ninth flat tube group.

* * * * *